United States Patent [19]

Kawamura et al.

[11] Patent Number: 4,526,420

[45] Date of Patent: Jul. 2, 1985

[54] SEAT COVER FIXING CONSTRUCTION WITH SLIMMED SECTION MOUNTING BAND

[75] Inventors: Reiki Kawamura; Takuo Tanaka; Toshio Asano; Yasuhiro Sawada, all of Toyota, Japan

[73] Assignees: Toyota Jidosha Kabushiki Kaisha; Takashimaya Nippatsu Kogyo Co., Ltd., both of Toyota, Japan

[21] Appl. No.: 457,458

[22] Filed: Jan. 12, 1983

[51] Int. Cl.[3] ..... A47C 31/02

[52] U.S. Cl. ..... 297/218; 5/402; 297/219; 297/226

[58] Field of Search ..... 297/218, 219, 226, 452, 297/455; 5/402, 403, 406

[56] References Cited

U.S. PATENT DOCUMENTS

| | | | |
|---|---|---|---|
| 2,796,116 | 6/1957 | Wilfert | 5/402 |
| 2,845,998 | 8/1958 | Estabrook et al. | 297/219 X |
| 3,127,695 | 4/1964 | Driscoll et al. | 5/403 X |
| 3,197,789 | 8/1965 | Ashkouti et al. | 5/403 X |
| 3,596,989 | 8/1971 | Van Ryn et al. | 297/219 |
| 3,801,154 | 4/1974 | Holtquist et al. | 297/226 X |

FOREIGN PATENT DOCUMENTS

| | | | |
|---|---|---|---|
| 74607 | 12/1960 | France | 297/218 |

*Primary Examiner*—Victor N. Sakran
*Assistant Examiner*—Peter R. Brown
*Attorney, Agent, or Firm*—Oblon, Fisher, Spivak, McClelland & Maier

[57] ABSTRACT

A seat cover fixing construction for fixing a bag shaped seat cover to a seat. An engagement portion of the seat extends around the part of the seat near the edge of the seat cover, extends from the seat in the general direction away from the closed end of the bag shape of the seat cover, and is formed with a free edge. A resilient band is shaped as an endless ribbon, and a first edge of this band is coupled to and extends around the edge of the open end of the seat cover. The two edges of the band are of approximately the same length. The band is thinner at its central portion than at its two edges. The resilient band is engaged inside and around the engagement portion of the seat, with the first edge of the band lying generally next to the free edge of the engagement portion of the seat. Thus, the band has been turned inside out to fit under the engagement portion. Because at least one surface of the band is not planar, the parts of the band which are more curved, at the corners of the seat, are more resistant to twisting, than are the parts of the band which extend generally straight; and thus the seat cover is reliably held on the seat at these corners.

6 Claims, 7 Drawing Figures

SEAT COVER FIXING CONSTRUCTION WITH SLIMMED SECTION MOUNTING BAND

BACKGROUND OF THE INVENTION

1. Field of the Invention

The present invention relates to a seat cover fixing construction for fixing a seat cover to a seat, such as for example a seat of a passenger vehicle such as an automobile, and in particular relates to such a seat cover fixing construction in which the seat cover is secured to the seat by the use of a peripheral endless band which is turned inside out.

2. Description of the Prior Art

For fixing a seat cover to a seat, various fixing constructions have been proposed in the prior art. One particular such construction has been one in which the peripheral edge of the seat cover has been attached to an endless fixing band made of an appropriately stiff and rigid, yet elastic, material, such as, for example, ABS resin, polypropylene resin, vinyl chloride resin, AS resin, or the like. This edging band is formed like a frame, and in more detail is constructed from a ribbon shaped piece of said stiff material which is looped round and closed to itself, with the cross section of said ribbon at any point therealong being substantially an elongated rectangle the long side of which is substantially perpendicular to the general plane of the band. Such a band in perspective view looks generally like FIG. 5 of the accompanying drawings, which is applicable to this prior art as well as to the present invention, as will be explained later. The seat cover is placed over the seat to which it is to be attached, and then the fixing band is turned inside out, inwards to the inside of the seat cover. In other words, the lower edges of the band are pushed inwards and upwards while the upper edges thereof are pulled outwards and downwards around said inner edges, until the band flips around so that its former inner surface now becomes its outer surface and vice versa, with the lower edge portion of the seat cover now wrapped down over and around to the inside of said band. If the seat structure is appropriately arranged so that this inversion or turning inside out of the edging band of the seat cover causes said band now to be engaged around a lower part of the seat structure in a secure and positive manner, this can provide an ingenious, simple, cheap, and yet secure method for quickly fixing a seat cover to a seat without the use of special tools. Further, the seat cover can be quickly and easily detached from the seat, should that be necessary at any time, simply by reversing the turning inside out of the edging band thereof and by then lifting the seat cover off the seat.

However, a disadvantage exists with this prior art form of seat cover fixing construction, as follows. Since the twisting of the edging band of the seat cover to invert it is required to be fairly easily performed when fitting the seat cover, the twisting rigidity of said edging band around its central axial line is required to be fairly small, and according to this, when the seat is subjected to severe use conditions, as when a particularly corpulent person sits in the seat and slides to and fro thereon, there is a risk that the severe pulling of the seat cover caused thereby may twist the peripheral fixing band and cause it to come away from the part of the seat over which it is inverted, in the most extreme case again inverting this band and causing the seat cover to come away from the seat. Accordingly, a requirement has arisen for a form of seat cover construction which avoids this weakness.

SUMMARY OF THE INVENTION

Now, it has been noticed by the present inventors that this coming away of the fixing band from the seat, i.e. this twisting of the band caused by pulling on the seat cover during use, is particularly pronounced at the parts of the fixing band which are bent sharply, in other words at the corners of the seat. Accordingly it has occurred to the present inventors that if these parts of the peripheral fixing band could be caused to be more resistant to twisting than the other parts of the band, then this disadvantageous tendency for the band to be twisted and to come off the seat could be cured.

Accordingly, it is the primary object of the present invention to provide a seat cover fixing construction for fixing a seat cover to a seat, in the use of which the risk that the seat cover, when pulled, may come away from the seat is minimized.

It is a further object of the present invention to provide such a seat cover fixing construction, in which the rigidity of the parts of the construction which are located at and near the corners of the seat is caused to be greater than the rigidity of the other parts of the construction.

It is a further object of the present invention to provide such a seat cover fixing construction, incorporating such an edge band as described above, in which the sectional shape of the peripheral band is modified in order to cause said peripheral band to be more rigid when bent through a curve with a small radius.

It is a further object of the present invention to provide such a seat cover fixing construction, in which the band, when once turned inside out around a lower part of the seat, cannot easily slip down said lower part of said seat.

It is a further object of the present invention to provide such a seat cover fixing construction, in which the turning inside out of said peripheral band, to fit the seat cover to the seat, is facilitated.

It is a further object of the present invention to provide such a seat cover fixing construction, in which said endless band is prevented from rotating or slipping relative to said seat cover.

It is a yet further object of the present invention to provide such a seat cover fixing construction, which is capable of securely fixing the seat cover to the seat.

It is a yet further object of the present invention to provide such a seat cover fixing construction, in which the seat cover can be easily fixed to the seat.

It is a yet further object of the present invention to provide such a seat cover fixing construction, in which the seat cover can be easily dismounted from the seat, should it become necessary to do so.

According to the present invention, these and other objects are accomplished by a seat cover fixing construction for fixing a seat cover to a seat having a cushion structure and an annular engagement frame extending downward from a peripheral edge portion of said cushion structure, said cover having a central portion to cover said cushion structure and a peripheral edge portion to engage said annular engagement frame, said peripheral edge portion of said seat cover incorporating therein a resilient band shaped as an endless ribbon adapted to be inverted inside out along said annular engagement frame of said seat so as to follow an inside peripheral surface of said annular engagement frame while stretching said central portion of said seat cover over and around said cushion structure of said seat, said resilient band being so shaped as viewed in its cross section to be thinner at its central portion than at its opposite edge portions.

According to such structure, the resilient band is more readily twistable around its central axis, and therefore the turning of the resilient band inside out or outside in is readily proceeded from a portion of the resilient band gradually along the length thereof so that the whole annular portion of the resilient band, and, therefore, the whole peripheral edge portion of the seat cover, can be very easily mounted to the annular engagement flange of the seat or dismounted therefrom. However, since the thickened opposite edge portions of the resilient band provide strong tension and compression resisting members to the band, when the band has once been completely mounted to the annular engagement flange of the seat, the moment of inertia of the band along the plane which extends through the central axis of the band and through the center of the opposite edges of the band as viewed in the cross section thereof is very large, and therefore the band presents a strong resistance against a force which is generated by a shifting of the seat cover relative to the cushion structure and which is transmitted to the band via the sheet material of the cover so as to bend the band in said plane in which the torsional moment of the band is very large.

Further, according to a particular aspect of the present invention, these and other objects are more particularly and concretely accomplished by a seat cover fixing construction of the type described above, wherein said annular engagement frame of said seat is further formed with an inwardly extending lip portion.

According to such a structure, said inwardly extending lip is substantially helpful for preventing said resilient band from slipping away from said engagement portion of said seat, and accordingly the fixing effectiveness of the construction according to the present invention is greatly enhanced.

Further, according to a particular aspect of the present invention, these and other objects are more particularly and concretely accomplished by a seat cover fixing construction of the type first described above, wherein said resilient band is held within a tubular hem formed along said peripheral edge portion of said seat cover.

According to such a structure, the resilient band is simply and conveniently fixed to the edge of the seat cover by a cheap and easily manufactured construction.

Further, according to a particular aspect of the present invention, these and other objects are more particularly and concretely accomplished by a seat cover fixing construction of the type first described above, further comprising a rotation preventing member whose cross section is generally a narrow hollow rectangle, said rotation preventing member being disposed around a portion of said resilient band within said tubular hem.

According to such structure, this rotation preventing member is very helpful for preventing the slippage of the material of the tubular hem around the resilient band. Thus the alignment of the edge of the free portion of the seat cover with the aforesaid one edge of the resilient band, which is important for the proper operation of the fixing construction according to the present invention, is well assured.

Further, according to a particular aspect of the present invention, these and other objects are more particularly and concretely accomplished by a seat cover fixing construction of the sort proximately described above, wherein said rotation preventing member further comprises a portion which in cross section projects outwards from one end of said narrow hollow rectangle.

According to such a structure, this rotation preventing member is aided in its function, by the projecting portion digging in against the material of the tubular hem, when the material of the hem starts to move around the resilient band.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DETAILED DESCRIPTION OF THE PREFERRED EMBODIMENT

Figure 1:
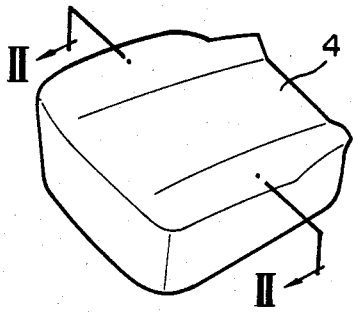
FIG. 1 is a perspective view of a seat with a seat cover fixed on it by the preferred embodiment of the seat cover fixing construction of the present invention.
Figure 2:
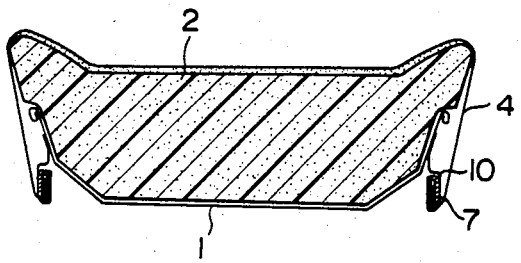
FIG. 2 is a sectional view through the seat of FIG. 1, taken in a plane shown by the arrows II—II in FIG. 1.

The present invention will now be described with reference to a preferred embodiment thereof, and with reference to the appended drawings. FIG. 1 shows a seat of an automotive vehicle, over which there has been fitted a seat cover 4. As shown in FIG. 2, which is a cross sectional view, the seat comprises a metallic seat lower frame 1 on which there is fixed a seat cushion structure 2. This seat cusion structure 2 may be made up of springs and/or rubber or plastic foam, and is per se well known. The seat cover 4 may be made of vinyl, leather, fabric, synthetic leather, or the like, and is also per se well known, and is formed with a central portion covering the upper and side portions of the seat cushion structure 2 and the seat frame 1, and with an annular peripheral edge portion fixed to the edge of the frame 1 by a seat cover fixing construction which is the preferred embodiment of the present invention, which will now be explained.

Figure 3:
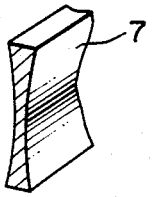
FIG. 3 is a perspective view of a portion of a peripheral fixing band attached around the edge of the seat cover shown in FIGS. 1 and 2 for fastening said seat cover to the seat, showing the cross sectional shape of said band.
Figure 4:
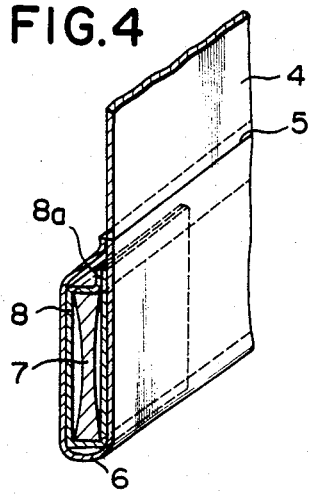
FIG. 4 is a perspective view of a section taken through said edge of said seat cover and through said fixing band attached thereto.

As best shown in FIG. 4, the peripheral edge portion of the seat cover 4 is turned around on itself, and its extreme edge is sewn by a radio frequency plastic sewing machine or the like along a line 5 to a part of said seat cover 4 a little spaced from said extreme edge so as to form a hollow or tubular hem 6, which when opened up constitutes a tube which is endless, extending around the entire periphery of the seat cover 4. Within this tubular hem 6 there is held an endless band 7, which is made of a wide yet thin ribbon of some material which is quite stiff and rigid, yet elastic, such as, for example, ABS resin, polypropylene resin, vinyl chloride resin, AS resin, or the like, with its ends 7*a* and 7*b* attached together via some per se well known bonding means. This endless band 7 is shown in perspective view in FIG. 5, and a portion thereof which is sectioned by a plane perpendicular to its axis is shown in FIG. 3.

Figure 5:
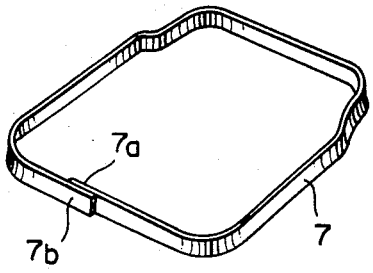
FIG. 5 is a perspective view of the entire fixing band, shown as detached from the seat cover.

In detail, particularly according to the principle of the present invention, the cross section of this fixing band 7 is formed not as a long thin rectangle, as was the case in the prior art, but with its central portion thinner than its opposite side edge portions. In other words, each of the sides of the ribbon out of which this fixing band 7 is constructed is made as a gently concave cylindrical trough, with the bottoms of these two troughs opposing one another through the thickness of the ribbon at its central portion, which is thus substantially less than the thickness of the ribbon at either of its edge portions. The annular band 7 is made of a straight band material, and therefore the preferred or equilibrium position of said band 7 is with one of its sides on the outside and one of its sides on the inside, or vice versa, in the same condition, as shown in FIG. 5.

Further, as a particular feature of the shown embodiment, around the endless fixing band 7 within the tubular hem 6 there is fitted a rotation preventing member 8, which may also be formed of a synthetic resin or the like, and which is generally formed as a hollow tube with a narrow rectangular cross section which fits around a part of the fixing member 7, further formed with a part 8*a* which in cross section extends out away from one end of said narrow rectangle. This rotation preventing member 8 is axially not very long; and may in fact be provided in plurality. It has the function of hindering or stopping the endless fixing band 7 from rotating around its central axis within the tubular hem 6. Thus, effectively, the edge of the free part of the seat cover 4 (i.e. the part of the seat cover 4 that is not wrapped around the band 7) is coupled to one edge (the upper edge in FIG. 4) of the ribbon shaped endless fixing band 7. However, this rotation preventing member 8 is not an essential feature of the present invention, but is a useful specialization thereof.

Figure 6:
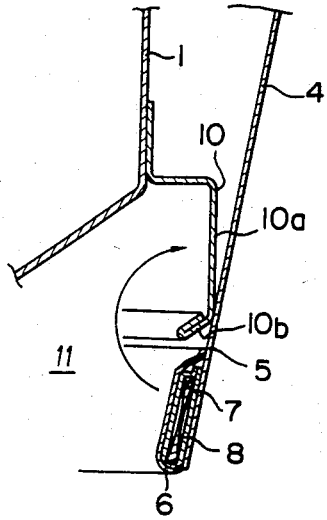
FIG. 6 is an enlarged sectional view of a lower part of the seat shown in FIGS. 1 and 2, with the seat cover and the fixing band attached thereto fitted over said seat, but with the fixing band not yet turned inside out so as to fix the seat cover to the seat.
Figure 7:
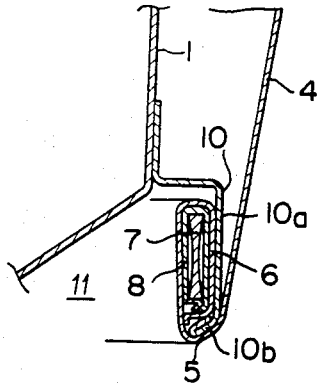
FIG. 7 is an enlarged sectional view, similar to FIG. 6, of a lower part of the seat shown in FIGS. 1 and 2, with the seat cover and the fixing band attached thereto fitted over said seat, and with the fixing band turned inside out so as to fix the seat cover to the seat.

As seen in FIGS. 6 and 7 in cross section, the lower part of the seat frame 1 is formed with an annular engagement flange or frame 10 around it, which comprises a downwardly projecting engagement rim 10*a* and an inwardly extending lip 10*b* which projects inwards from the lower edge of this engagement rim 10*a*. This inwardly extending lip 10*b*, again, is not an essential feature of the present invention, but constitutes a useful specialization thereof.

Now, when the seat cover 4 with the peripheral band 7 mounted around the lower edge thereof is to be fitted to the seat, first the seat cover 4 is slipped over the seat cushion 2 and the seat frame 1 so that the peripheral edge portion of said seat cover 4 including the hollow hem 6 with the endless engagement band 7 contained therein projects downwards below the lower edge of the engagement rim 10*a* of the seat frame 1. This state of the parts is shown in FIG. 6 in enlarged cross section. Next, starting from a part of the whole annular peripheral edges, the lower edge of the peripheral band 7 is pushed inwards and upwards while the upper edge thereof is kept stationary or is pulled outwards and downwards relative to said lower edge, as illustrated by the circular arrow in FIG. 6, and accordingly the peripheral band 7 snaps round so as to be turned inside out, with the former outer surface thereof now the inside surface and the former inside surface thereof now the outside surface. Further, the former upper edge of said peripheral band 7 now becomes the lower edge thereof, so that, as seen in FIG. 7, the band 7 is raised through space 11 having a width at least as wide as the cross-sectional length of the band 7, and becomes tucked up on the inside of and solely engages the downwardly projecting engagement rim 10*a* of the engagement portion 10 of the seat frame 1, with the resiliency of this band 7 pushing it outwards so as to cause it to be pushed against the inside of said engagement rim 10*a* to be securely engaged thereto. Thereby, the seat cover 4 is securely engaged to the seat frame 1.

According to the principle of the present invention, because the cross section of the engaging band 7 is shaped as shown in FIG. 3, the stiffness or resistance to twisting of this band 7 is much reduced relative to the moment of inertia which determines the stiffness or resistance to bending available when the band has been mounted to extend along the inside of the annular engagement rim 10*a*. Accordingly this new balance between the increased stiffness of the band 7 to bending in stationary operation and the twistability in assembling and disassembling created by the shaping of the band 7 as shown in FIG. 3 is extremely effective for improving the fixing efficiency of this construction as a whole.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, only one of the surfaces of the band 7 could be formed as a trough, the other being planar. Other modifications are possible. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. A seat cover fixing construction for fixing a seat cover to a seat having a cushion structure and a lower seat frame with an annular engagement flange extending downward from a peripheral edge portion of said lower seat frame, said cover having a central portion to cover said cushion structure and a peripheral edge portion to engage said annular engagement flange, said peripheral edge portion of said seat cover incorporating therein a resilient band shaped as an endless ribbon adapted to be inverted inside out along said annular engagement flange of said seat so as to solely engage an inside peripheral surface of said annular engagement flange while stretching said central portion of said seat cover over and around said cushion structure of said seat, said resilient band being so shaped as viewed in its cross section to be thinner at its central portion than at its opposite edge portions wherein said lower seat frame and said annular engagement flange define an open space being at least as wide as a cross-sectional length dimension of said resilient band thereby providing space for said resilient band to be inverted after placement of said peripheral edge portion of said seat cover over said engagement flange.

2. A seat cover fixing construction according to claim 1, wherein said annular engagement flange of said seat is further formed with a downwardly and an inwardly extending lip portion.

3. A seat cover fixing construction according to claim 1, wherein said resilient band is held within a tubular hem formed along said peripheral edge portion of said seat cover.

4. A seat cover fixing construction according to claim 1, wherein at least one side of said resilient band is formed as a shallow trough.

5. A seat cover fixing construction for fixing a seat cover to a seat having a cushion structure and a lower seat frame with an annular engagement flange extending downward from a peripheral edge portion of said lower seat frame, said cover having a central portion to cover said cushion structure and a peripheral edge portion to engage said annular engagement flange, said peripheral edge portion of said seat cover incorporating therein a resilient band shaped as an endless ribbon adapted to be inverted inside out along said annular engagement flange of said seat so as to solely engage an inside peripheral surface of said annular engagement flange while stretching said central portion of said seat cover over and around said cushion structure of said seat, said resilient band being so shaped as viewed in its cross section to be thinner at its central portion than at its opposite edge portions; and a rotation preventing member having a cross section of a narrow hollow rectangle shape, said rotation preventing member being disposed around at least a portion of said resilient band and within said tubular hem.

6. A seat cover fixing construction according to claim 5, wherein said rotation preventing member further comprises a portion which in cross section projects outwardly from one end of said narrow hollow rectangle.

* * * * *